US008474632B2

(12) United States Patent
Yang et al.

(10) Patent No.: US 8,474,632 B2
(45) Date of Patent: Jul. 2, 2013

(54) SHELVING SYSTEM

(75) Inventors: Frank Yang, Rancho Palos Verdes, CA (US); Joseph Sandor, Santa Ana Heights, CA (US)

(73) Assignee: simplehuman, LLC, Torrance, CA (US)

( * ) Notice: Subject to any disclaimer, the term of this patent is extended or adjusted under 35 U.S.C. 154(b) by 198 days.

(21) Appl. No.: 12/628,453

(22) Filed: Dec. 1, 2009

(65) Prior Publication Data

US 2010/0133218 A1 Jun. 3, 2010

Related U.S. Application Data

(60) Provisional application No. 61/118,986, filed on Dec. 1, 2008.

(51) Int. Cl.

| | |
|---|---|
| ***A47F 5/08*** | (2006.01) |
| *A47G 29/087* | (2006.01) |
| *A47H 1/14* | (2006.01) |
| *A47B 96/06* | (2006.01) |

(52) U.S. Cl.
USPC ..... 211/90.01; 211/94.01; 211/88.01; 211/119.009; 248/251; 248/214

(58) Field of Classification Search
USPC ..... 211/16, 18, 63, 75, 87.01, 88.04, 211/90.02, 105.1, 106.01, 119.009, 123, 211/94.01, 70.6, 124, 89.01, 162, 182, 88.01; 248/251, 214, 200.1, 243, 225.11, 222.13
See application file for complete search history.

(56) References Cited

U.S. PATENT DOCUMENTS

| | | | | |
|---|---|---|---|---|
| 141,186 | A | 7/1873 | Thomas | |
| 163,852 | A | 6/1875 | Denman | |
| 181,593 | A | 8/1876 | Randall | |
| 387,758 | A | 8/1888 | Barnhart | |
| 397,558 | A * | 2/1889 | Lumley | 211/69.2 |
| 434,708 | A | 8/1890 | Grier | |
| 475,020 | A | 5/1892 | Perry | |
| 477,291 | A | 6/1892 | Bomar | |
| 496,961 | A | 5/1893 | Trude | |
| 527,273 | A * | 10/1894 | Fowler | 211/105.6 |
| 536,272 | A * | 3/1895 | Edsall | 211/105.6 |
| 543,935 | A | 8/1895 | Hostler | |

(Continued)

FOREIGN PATENT DOCUMENTS

FR 2549361 1/1985

OTHER PUBLICATIONS

U.S. Appl. No. 29/334,143, filed Mar. 30, 2009, Yang et al.
U.S. Appl. No. 29/351,158, filed Dec. 1, 2009, Yang et al.

(Continued)

*Primary Examiner* — Joshua J Michener
*Assistant Examiner* — Devin Barnett
(74) *Attorney, Agent, or Firm* — Knobbe Martens Olson & Bear LLP

(57) ABSTRACT

A caddy for use in bathrooms is disclosed. The caddy can include removable shelf assemblies and/or accessory units for holding common household items. The removable shelf accessories can include knobs which can be turned to secure and free the shelf assemblies from a support member of the caddy. The accessory units can snap into place on the support member. The support member can include a telescoping section and biasing element which permits the caddy to adjust to different sized bathrooms. A sliding member can be incorporated to provide additional areas for attachment of shelf assemblies or accessory units.

12 Claims, 18 Drawing Sheets

U.S. PATENT DOCUMENTS

| | | | | | |
|---|---|---|---|---|---|
| 612,061 | A | | 10/1898 | Shambaugh | |
| 613,231 | A | * | 11/1898 | Bennett | 211/88.01 |
| 618,425 | A | | 1/1899 | Manger | |
| 626,739 | A | | 6/1899 | Vanderman | |
| 644,080 | A | | 2/1900 | Huebel | |
| 661,755 | A | * | 11/1900 | Thurstensen | 248/243 |
| 839,339 | A | | 12/1906 | Tuttle | |
| 841,866 | A | * | 1/1907 | Hollis | 211/162 |
| 845,917 | A | | 3/1907 | Worley | |
| 913,955 | A | | 3/1909 | Hansen | |
| 970,485 | A | | 9/1910 | Frey | |
| 1,026,149 | A | | 5/1912 | Crane | |
| 1,071,428 | A | | 8/1913 | Jones | |
| 1,254,094 | A | * | 1/1918 | Vogt | 248/243 |
| 1,446,036 | A | | 2/1923 | Dodd | |
| 1,478,339 | A | | 12/1923 | Jayne | |
| 1,511,704 | A | | 10/1924 | Buck | |
| 1,554,137 | A | | 9/1925 | Slifkin | |
| 1,582,762 | A | | 4/1926 | Klock | |
| 1,639,551 | A | * | 8/1927 | Booth | 211/105.6 |
| 1,931,321 | A | * | 10/1933 | Keil | 248/243 |
| 2,012,452 | A | | 8/1935 | Littell | |
| 2,042,517 | A | | 6/1936 | Ellis | |
| 2,157,309 | A | * | 5/1939 | Swedman et al. | 248/243 |
| 2,199,851 | A | * | 5/1940 | Culver | 248/264 |
| 2,254,770 | A | | 9/1941 | Bitney | |
| 2,513,889 | A | | 7/1950 | Nillson | |
| 2,675,782 | A | * | 4/1954 | Lage | 119/61.1 |
| 2,677,519 | A | | 5/1954 | Hobson | |
| 2,746,661 | A | | 5/1956 | Kaplan | |
| 2,788,902 | A | * | 4/1957 | Nowicki | 108/157.13 |
| 2,837,219 | A | * | 6/1958 | Ferdinand et al. | 108/65 |
| 2,923,415 | A | | 2/1960 | Brown | |
| 2,923,428 | A | * | 2/1960 | Averill | 220/486 |
| 2,928,512 | A | * | 3/1960 | Slater et al. | 403/22 |
| 2,932,873 | A | | 4/1960 | Reichert | |
| 2,936,146 | A | * | 5/1960 | Wunder | 248/201 |
| 2,937,766 | A | | 5/1960 | Penn | |
| 2,941,669 | A | | 6/1960 | Palay et al. | |
| D188,332 | S | | 7/1960 | Salen | |
| D189,722 | S | | 2/1961 | Wolf | |
| 2,976,003 | A | | 3/1961 | Foster | |
| 2,977,953 | A | | 4/1961 | Dowdy | |
| 3,035,708 | A | | 5/1962 | Freeman | |
| 3,043,440 | A | | 7/1962 | Berlin | |
| 3,059,374 | A | | 10/1962 | Bernay | |
| 3,088,598 | A | | 5/1963 | Werneke | |
| D195,412 | S | | 6/1963 | Vernik | |
| 3,111,723 | A | | 11/1963 | Bates | |
| 3,115,107 | A | | 12/1963 | Glenny | |
| 3,119,496 | A | * | 1/1964 | Burk | 211/105.1 |
| 3,124,253 | A | * | 3/1964 | Petrich | 211/94.01 |
| 3,132,609 | A | | 5/1964 | Chesley | |
| 3,138,260 | A | * | 6/1964 | Tedrick | 211/18 |
| 3,181,923 | A | | 5/1965 | Guillon et al. | |
| 3,239,182 | A | * | 3/1966 | Blanz | 248/682 |
| 3,266,764 | A | | 8/1966 | Briles | |
| 3,307,710 | A | | 3/1967 | Negri | |
| 3,319,983 | A | | 5/1967 | Zibell | |
| 3,343,685 | A | | 9/1967 | Giambalvo | |
| 3,471,031 | A | * | 10/1969 | Coplan | 211/119.009 |
| 3,593,857 | A | | 7/1971 | Hernes | |
| D222,276 | S | | 10/1971 | Hughes, Jr. | |
| 3,641,922 | A | | 2/1972 | Nachazel et al. | |
| 3,661,121 | A | * | 5/1972 | Zielin | 119/61.57 |
| 3,695,455 | A | | 10/1972 | Larson | |
| 3,710,096 | A | * | 1/1973 | McFarlin | 248/27.1 |
| 3,787,078 | A | | 1/1974 | Williams | |
| 3,789,996 | A | | 2/1974 | Stroh | |
| 3,791,091 | A | | 2/1974 | Albrizzi | |
| 3,807,574 | A | | 4/1974 | Lanza | |
| 3,854,686 | A | | 12/1974 | Konstant | |
| 3,894,707 | A | * | 7/1975 | Heard | 248/230.9 |
| 3,907,119 | A | | 9/1975 | Franz | |
| 3,923,162 | A | | 12/1975 | Hussey | |
| D239,579 | S | | 4/1976 | Taub | |
| 3,954,182 | A | * | 5/1976 | McEvers | 211/94.01 |
| 3,983,823 | A | * | 10/1976 | McDonnell | 108/147.11 |
| 3,998,334 | A | | 12/1976 | Smith | |
| 4,018,019 | A | * | 4/1977 | Raith et al. | 52/239 |
| 4,033,539 | A | | 7/1977 | Bardocz | |
| 4,059,915 | A | * | 11/1977 | Owens | 40/610 |
| 4,096,951 | A | | 6/1978 | Menssen | |
| 4,106,736 | A | | 8/1978 | Becker et al. | |
| 4,154,356 | A | * | 5/1979 | Schieve | 220/480 |
| 4,192,426 | A | * | 3/1980 | Gauthier | 211/105.4 |
| 4,215,840 | A | * | 8/1980 | Babberl | 248/220.22 |
| 4,232,790 | A | | 11/1980 | Serrano | |
| 4,274,400 | A | | 6/1981 | Baus | |
| 4,310,193 | A | * | 1/1982 | Kolleas | 296/75 |
| 4,360,283 | A | | 11/1982 | Psotta | |
| 4,387,811 | A | | 6/1983 | Ragir et al. | |
| 4,415,091 | A | | 11/1983 | Wolff | |
| 4,428,488 | A | | 1/1984 | McAvinn et al. | |
| 4,437,450 | A | | 3/1984 | Connelly | |
| D273,645 | S | * | 5/1984 | McEvers | D6/513 |
| D274,201 | S | | 6/1984 | Aaron | |
| 4,511,047 | A | | 4/1985 | Elinsky | |
| 4,541,131 | A | | 9/1985 | Sussman | |
| 4,559,879 | A | | 12/1985 | Hausser | |
| D286,599 | S | | 11/1986 | Sussman | |
| D289,353 | S | | 4/1987 | Davis et al. | |
| 4,664,428 | A | | 5/1987 | Bridges | |
| 4,761,092 | A | | 8/1988 | Nakatani | |
| 4,771,897 | A | * | 9/1988 | Ho | 211/85.9 |
| 4,771,899 | A | * | 9/1988 | Benedict et al. | 211/60.1 |
| 4,776,471 | A | | 10/1988 | Elkins | |
| 4,786,022 | A | | 11/1988 | Grieshaber | |
| 4,805,784 | A | * | 2/1989 | Solheim et al. | 211/94.01 |
| 4,860,909 | A | | 8/1989 | Leumi | |
| 4,865,283 | A | | 9/1989 | Parker | |
| 4,869,378 | A | * | 9/1989 | Miller | 211/94.01 |
| 4,869,379 | A | * | 9/1989 | Hawkrige | 211/100 |
| 4,883,399 | A | * | 11/1989 | MacLean | 411/431 |
| 4,895,331 | A | | 1/1990 | Nehls | |
| 4,909,467 | A | | 3/1990 | Shan-Pao | |
| D314,294 | S | | 2/1991 | Axhamre | |
| 4,998,647 | A | | 3/1991 | Sharp | |
| 5,014,860 | A | | 5/1991 | Emery | |
| 5,023,755 | A | | 6/1991 | Rosenberg | |
| 5,127,528 | A | | 7/1992 | Cone | |
| 5,160,101 | A | | 11/1992 | Ferraro et al. | |
| 5,180,067 | A | | 1/1993 | Conaway et al. | |
| 5,190,170 | A | * | 3/1993 | Steiner | 211/104 |
| 5,192,427 | A | | 3/1993 | Eger et al. | |
| 5,197,614 | A | | 3/1993 | Dalton et al. | |
| 5,255,401 | A | | 10/1993 | Sambrookes et al. | |
| 5,284,260 | A | | 2/1994 | Caligiuri, Sr. | |
| 5,307,797 | A | | 5/1994 | Kleefeld | |
| 5,318,175 | A | | 6/1994 | Stevens | |
| D351,751 | S | | 10/1994 | Brightbill et al. | |
| 5,355,867 | A | | 10/1994 | Hall et al. | |
| 5,429,252 | A | * | 7/1995 | Liu | 211/94.01 |
| 5,462,178 | A | | 10/1995 | Wallach et al. | |
| 5,483,761 | A | | 1/1996 | Simpson | |
| 5,505,318 | A | | 4/1996 | Goff | |
| 5,524,772 | A | | 6/1996 | Simmons | |
| 5,527,273 | A | | 6/1996 | Manna et al. | |
| 5,588,543 | A | | 12/1996 | Finger | |
| 5,632,049 | A | | 5/1997 | Chen | |
| D382,733 | S | | 8/1997 | Goetz | |
| 5,666,940 | A | | 9/1997 | Kreiter | |
| 5,692,817 | A | * | 12/1997 | Jun et al. | 312/408 |
| 5,697,508 | A | * | 12/1997 | Rifkin et al. | 211/162 |
| 5,702,010 | A | | 12/1997 | Liang | |
| D388,642 | S | | 1/1998 | Winter | |
| 5,735,413 | A | | 4/1998 | Allen | |
| 5,772,048 | A | | 6/1998 | Sopcisak | |
| 5,772,050 | A | | 6/1998 | Shih | |
| D396,379 | S | | 7/1998 | Stoetzl | |
| D396,585 | S | | 8/1998 | Hofman | |
| 5,833,192 | A | | 11/1998 | Buhrman | |
| D402,145 | S | | 12/1998 | Hofman et al. | |
| 5,855,184 | A | * | 1/1999 | Eichler et al. | 119/51.5 |
| 5,855,286 | A | | 1/1999 | Zaid | |
| 5,897,002 | A | * | 4/1999 | Carlino | 211/70.6 |
| 5,899,423 | A | | 5/1999 | Albertini | |

| | | | | |
|---|---|---|---|---|
| 5,934,636 | A | 8/1999 | Cyrell | |
| 5,941,397 | A | 8/1999 | Buchanan et al. | |
| 5,984,114 | A | 11/1999 | Frankel | |
| D417,991 | S | 12/1999 | Hofman et al. | |
| D419,020 | S | 1/2000 | Emery et al. | |
| 6,017,009 | A | 1/2000 | Swartz et al. | |
| D421,692 | S | 3/2000 | Wojtowicz et al. | |
| D421,867 | S | 3/2000 | Carville et al. | |
| 6,050,426 | A * | 4/2000 | Leurdijk | 211/94.01 |
| D424,355 | S | 5/2000 | Barton | |
| 6,065,618 | A | 5/2000 | Stetler | |
| D427,469 | S * | 7/2000 | Thurston-Chartraw et al. | D6/525 |
| D429,934 | S | 8/2000 | Hofman | |
| 6,113,042 | A | 9/2000 | Welsch et al. | |
| 6,119,878 | A * | 9/2000 | Zen | 211/94.01 |
| 6,123,303 | A * | 9/2000 | Huang | 248/241 |
| 6,135,668 | A | 10/2000 | Lin | |
| 6,152,312 | A * | 11/2000 | Nava et al. | 211/94.01 |
| 6,206,206 | B1 * | 3/2001 | Saylor et al. | 211/46 |
| 6,233,877 | B1 * | 5/2001 | Monroe | 52/37 |
| D443,162 | S | 6/2001 | Winter | |
| D444,333 | S | 7/2001 | Ferrer Beltran | |
| D446,670 | S | 8/2001 | Emery et al. | |
| 6,302,280 | B1 | 10/2001 | Bermes | |
| 6,311,856 | B2 | 11/2001 | Battaglia et al. | |
| 6,318,572 | B1 | 11/2001 | Lai | |
| 6,347,777 | B1 | 2/2002 | Webber et al. | |
| 6,378,709 | B1 | 4/2002 | Stuart | |
| 6,394,404 | B1 | 5/2002 | Cyrell | |
| 6,409,029 | B1 | 6/2002 | Bermes | |
| D462,552 | S | 9/2002 | Emery et al. | |
| 6,481,586 | B1 | 11/2002 | Hoff | |
| 6,494,327 | B2 | 12/2002 | Huang | |
| 6,502,794 | B1 * | 1/2003 | Ting | 248/206.2 |
| D470,703 | S | 2/2003 | Hoernig | |
| 6,520,351 | B1 | 2/2003 | Zadro | |
| 6,527,473 | B2 | 3/2003 | Chen | |
| D473,411 | S | 4/2003 | Walker | |
| 6,540,430 | B2 | 4/2003 | Hsu | |
| 6,550,739 | B1 | 4/2003 | Brindisi | |
| 6,551,226 | B1 | 4/2003 | Webber et al. | |
| D475,560 | S | 6/2003 | Suero, Jr. | |
| D475,561 | S | 6/2003 | Suero, Jr. | |
| 6,575,315 | B2 | 6/2003 | Zidek | |
| 6,581,790 | B1 | 6/2003 | Zadro | |
| 6,591,996 | B1 * | 7/2003 | Wu | 211/90.02 |
| 6,619,164 | B1 | 9/2003 | Ricci et al. | |
| 6,648,152 | B2 | 11/2003 | Bermes | |
| D483,251 | S * | 12/2003 | Suero, Jr. | D8/376 |
| 6,688,238 | B1 | 2/2004 | Alexiou | |
| 6,726,034 | B2 | 4/2004 | Holbrook et al. | |
| D489,207 | S | 5/2004 | Rosen | |
| D492,188 | S | 6/2004 | Goldberg | |
| 6,758,355 | B2 | 7/2004 | Zidek | |
| D493,991 | S | 8/2004 | Dretzka | |
| 6,824,000 | B2 * | 11/2004 | Samelson | 211/105.3 |
| 6,824,225 | B2 * | 11/2004 | Stiffler | 299/104 |
| 6,848,144 | B1 | 2/2005 | McDonald | |
| 6,871,748 | B2 | 3/2005 | Suttles | |
| 6,918,498 | B2 | 7/2005 | Sparkowski | |
| D509,361 | S | 9/2005 | Suero, Jr. | |
| 6,957,794 | B2 | 10/2005 | Landreville et al. | |
| D512,861 | S | 12/2005 | Rosen | |
| 6,983,853 | B1 | 1/2006 | Ficket | |
| D516,901 | S | 3/2006 | Murray | |
| 7,021,814 | B2 * | 4/2006 | Berardi | 362/650 |
| 7,059,271 | B2 * | 6/2006 | Santa Cruz et al. | 119/60 |
| 7,086,633 | B2 | 8/2006 | Welch et al. | |
| D530,551 | S | 10/2006 | Snell | |
| D533,283 | S * | 12/2006 | Holztrager | D25/123 |
| D534,062 | S | 12/2006 | Van den Bosch | |
| 7,195,213 | B2 | 3/2007 | Weatherly | |
| D543,747 | S | 6/2007 | Harwanko | |
| D544,786 | S * | 6/2007 | Barrese | D8/376 |
| 7,229,059 | B1 | 6/2007 | Hood | |
| D546,879 | S | 7/2007 | Qiu | |
| 7,246,711 | B1 | 7/2007 | Metcalf | |
| D552,393 | S | 10/2007 | Rosen | |
| D564,257 | S | 3/2008 | Yang et al. | |
| 7,347,197 | B2 | 3/2008 | Hankinson | |
| D566,991 | S | 4/2008 | Harwanko | |
| D568,657 | S | 5/2008 | Snider | |
| D568,658 | S | 5/2008 | Yang et al. | |
| D569,148 | S | 5/2008 | Yang et al. | |
| D572,060 | S | 7/2008 | Snider | |
| D572,502 | S | 7/2008 | Yang et al. | |
| D572,516 | S | 7/2008 | Snider | |
| D573,386 | S | 7/2008 | Clucas | |
| D573,387 | S | 7/2008 | Walker | |
| D573,822 | S | 7/2008 | Yang et al. | |
| 7,398,790 | B2 | 7/2008 | Glatz | |
| 7,401,754 | B2 | 7/2008 | Welch et al. | |
| D574,649 | S | 8/2008 | Snider | |
| D574,650 | S | 8/2008 | Snider | |
| 7,407,060 | B2 * | 8/2008 | Swartz et al. | 211/94.01 |
| D578,815 | S | 10/2008 | Dominique et al. | |
| D587,504 | S | 3/2009 | Russell et al. | |
| D589,728 | S * | 4/2009 | Shaha et al. | D6/510 |
| D598,688 | S * | 8/2009 | Yang et al. | D6/525 |
| 7,591,385 | B2 * | 9/2009 | Brooks | 211/94.01 |
| 7,975,653 | B2 * | 7/2011 | Cash | 119/467 |
| 2001/0004064 | A1 | 6/2001 | Battaglia et al. | |
| 2002/0158033 | A1 | 10/2002 | Chen | |
| 2002/0172549 | A1 | 11/2002 | Koros et al. | |
| 2003/0000905 | A1 | 1/2003 | Zidek | |
| 2003/0132181 | A1 * | 7/2003 | Saulnier-Matteini | 211/153 |
| 2003/0136782 | A1 * | 7/2003 | Dicello et al. | 220/23.83 |
| 2003/0222191 | A1 * | 12/2003 | Tsai | 248/354.1 |
| 2004/0188577 | A1 | 9/2004 | Gaderick | |
| 2005/0040301 | A1 | 2/2005 | Walter | |
| 2005/0139562 | A1 | 6/2005 | Chen | |
| 2005/0205509 | A1 | 9/2005 | Flynn | |
| 2005/0205722 | A1 | 9/2005 | Krueger | |
| 2006/0038097 | A1 * | 2/2006 | Diller | 248/218.4 |
| 2006/0124812 | A1 * | 6/2006 | Berardi | 248/225.11 |
| 2006/0130381 | A1 * | 6/2006 | Caterinacci | 40/607.04 |
| 2006/0180561 | A1 * | 8/2006 | Wisnoski et al. | 211/94.01 |
| 2006/0261022 | A1 | 11/2006 | Sampaio | |
| 2007/0045208 | A1 | 3/2007 | Quan | |
| 2007/0194191 | A1 * | 8/2007 | Persson | 248/225.11 |
| 2007/0235611 | A1 | 10/2007 | Riblet | |
| 2007/0295681 | A1 | 12/2007 | Colin | |
| 2008/0000859 | A1 | 1/2008 | Yang et al. | |
| 2008/0035592 | A1 * | 2/2008 | Yang et al. | 211/119.009 |
| 2008/0053935 | A1 | 3/2008 | Newbouild et al. | |
| 2008/0142669 | A1 | 6/2008 | Zlotocha | |
| 2009/0134290 | A1 * | 5/2009 | Begic et al. | 248/222.13 |
| 2009/0188880 | A1 | 7/2009 | Yang et al. | |
| 2010/0000449 | A1 * | 1/2010 | Botkin | 108/152 |
| 2011/0271438 | A1 | 11/2011 | Yang et al. | |

OTHER PUBLICATIONS

U.S. Appl. No. 29/357,567, filed Mar. 12, 2010, Yang et al.

U.S. Appl. No. 29/357,568, filed Mar. 12, 2010, Yang et al.

U.S. Appl. No. 29/357,566, filed Mar. 12, 2010, Yang et al.

Partial European Search Report for European Application No. EP 07008098, dated Mar. 28, 2011, in 9 pages.

* cited by examiner

SHELVING SYSTEM

This application claims benefit under 35 U.S.C. §119(e) to U.S. Provisional Patent Application No. 61/118,986, filed Dec. 1, 2008, the entire contents of which is hereby expressly incorporated by reference.

BACKGROUND OF THE INVENTIONS

1. Field of the Inventions

The present inventions are directed to devices that can be used for organizing personal articles, for example, to shelving systems having adjustable shelves.

2. Description of the Related Art

Shelving devices, such as those commonly known as "shower caddies," are commonly used in shower and bath enclosures to store and organize personal care articles, such as shampoo, soap, toothbrushes, bath sponges, washcloths, etc. Shower caddies typically include shelves or baskets for holding the personal care items.

SUMMARY OF THE INVENTIONS

An aspect of at least one of the embodiments disclosed herein includes the realization that shower caddies with shelves can be advantageous, but often the number of shelves and/or their placement can be undesirable. For example, shower caddy shelves can often times get in the way of larger sized articles, and/or make it difficult to have a shower caddy generally balanced in weight on either side of a support member. It would be advantageous to have a shower caddy which includes removable shelf units which can be attached at various locations along a support member of the shower caddy.

Thus, in accordance with an embodiment, a shelving system can comprise an elongate telescoping support member comprising a biasing element configured to bias ends of the elongate support member against support structures, at least one removable shelf assembly attached to the elongate support member, the at least one removable shelf assembly comprising a bracket, a basket portion attached to the bracket, and a knob extending through a cut-out portion of the bracket. The knob can comprise engaging portions configured to engage a groove on the elongate support member when the knob is turned in a locking direction.

Another aspect of at least one of the embodiments disclosed herein includes the realization that bathrooms come in different shapes and sizes, as do showers and bathtubs. It would be advantageous to have a shower caddy which can adjust to different sized bathrooms, and still generally maintain the same tension and support.

Thus, in accordance with another embodiment, a method of securing a shelving system between two supporting structures can comprise providing a shelving system comprising an elongate support member, the elongate support member comprising a first segment, a second segment, and a third segment, the second segment having a cross-sectional area smaller than that of the first and third segments such that the second segment is slidable within at least one of the first and third segments, and wherein the second segment comprises a biasing element with a free-floating base portion, telescopingly adjusting the second segment until the elongate support member is at a desired length, fastening the first segment to the base portion of the biasing element, and pushing the third segment towards the first segment to compress the third segment against the biasing element until the elongate support member is at an overall length small enough to fit the elongate member between the supporting structures.

Another aspect of at least one of the embodiments disclosed herein includes the realization that with telescoping portions, the shelf assemblies may not always be able to attach to the support member of the caddy.

Thus, in accordance with another embodiment, a shelving system can comprise an elongate telescoping support member comprising a first segment, a second segment, and a third segment, the second segment being smaller in cross-sectional area than the first and third segments, a sliding member attached to the second segment, and a removable accessory unit attached to the sliding member and configured to frictionally engage an elongate groove along the sliding member, the removable accessory unit including at least one of a hook or shelf.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENT

An improved shelving system 10 is disclosed herein. The embodiments disclosed herein are described in the context of a shower caddy because the embodiments disclosed herein have particular utility in this context. However, the embodiments and inventions herein can also be applied to types of shelving systems configured for other types of environments.

Figure 1:
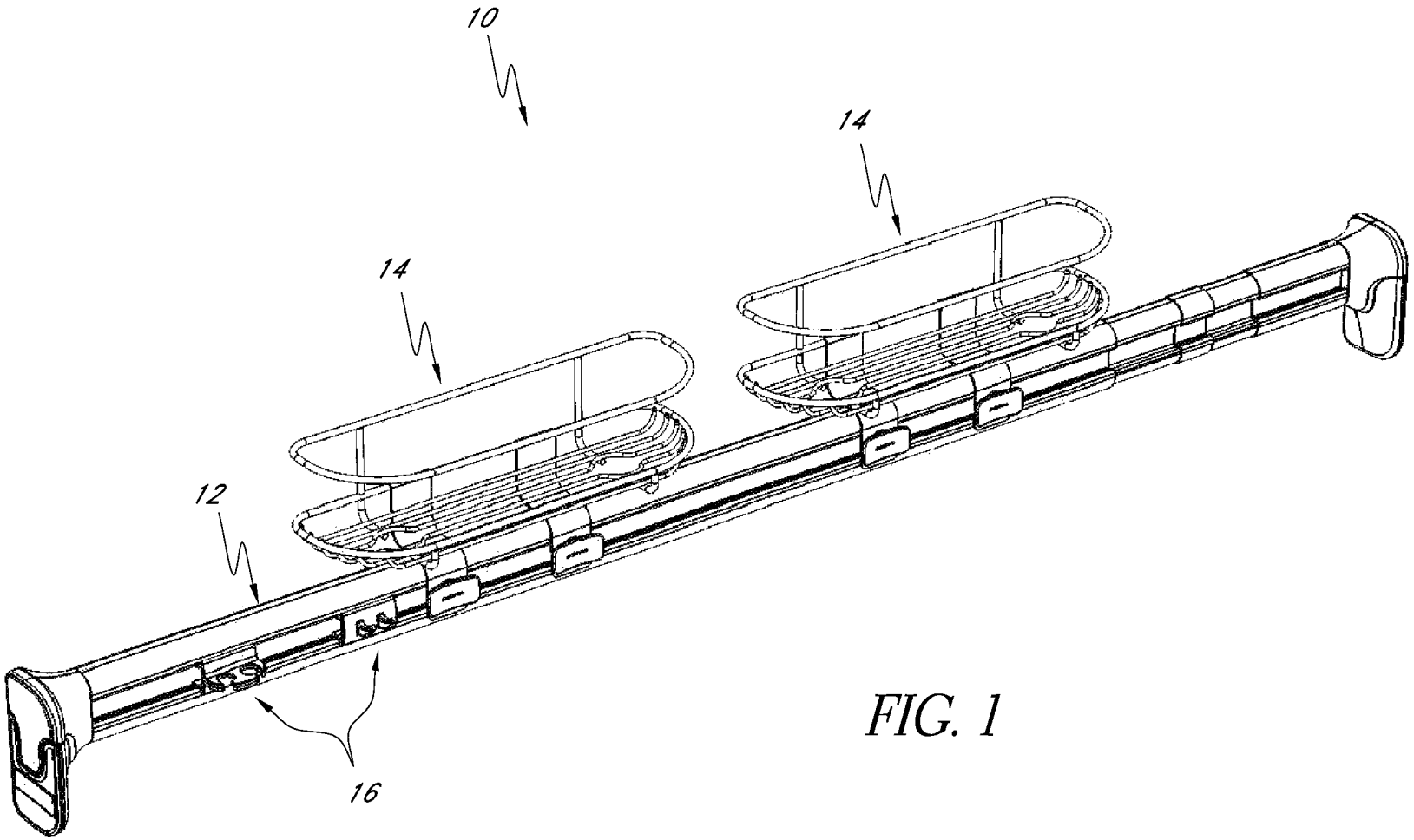
FIG. 1 is a top, front, and right side perspective view of a shower caddy constructed in accordance with an embodiment and having a support member, two removable shelf assemblies, and two removable accessory units.

With reference to FIG. 1, the shower caddy 10 can comprise a support member 12. In some embodiments, the support member 12 can comprise an elongate tension rod. The support member 12 can comprise at least one telescoping section, as well as an internal biasing element, such as a spring, to bias opposite ends of the support member 12 away from one another and towards stationary objects, such as the walls of a shower.

The support member 12 can be affixed to the walls of a shower, bathtub, or other supporting structure in a bathroom. The support member 12 can be configured to be positionable in an orientation in the shower such that it is elongated in a generally horizontal direction parallel to the shower or bathroom floor. Because bathtubs, showers, and bathrooms come in various sizes and shapes, an adjustable support member 12 can allow the same shower caddy 10 to be used in a variety of bathroom or shower environments.

With continued reference to FIG. 1, the shower caddy 10 can comprise at least one removable shelf assembly 14, and/or at least one removable accessory unit 16. The shelf assemblies 14 and removable accessory units 16 can attach to the support member 12 at one or more points along the support member 12, and can include a portion or portions which extend above and/or below the support member 12.

Figure 1A:
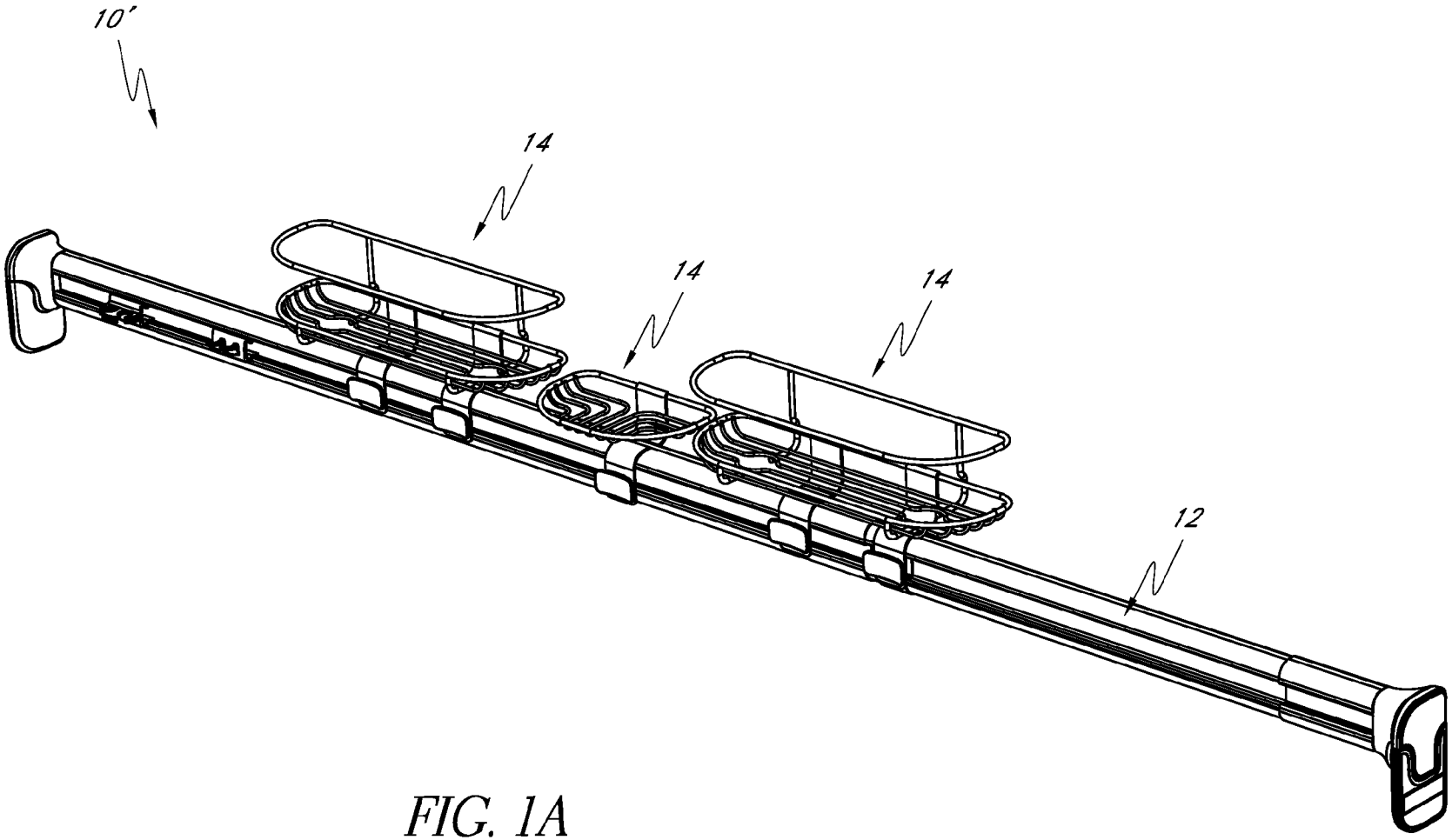
FIG. 1A is a top, front, and right side perspective view of a shower caddy constructed in accordance with another embodiment.

Although the illustrated embodiment of the shower caddy 10 has three shelf assemblies 14, the skilled artisan will understand that the shower caddy 10 may have only one shelf assembly 14 or as many shelf assemblies as will fit on the shower caddy 10. Furthermore, although the shower caddy 10 in the illustrated embodiment has shelf assemblies 14 having certain configurations, the skilled artisan will appreciate that the shelf assemblies 14 can have different configurations. For example, FIG. 1A illustrates another embodiment of a shower caddy 10'. The shower caddy 10' is similar to shower caddy 10, and has a smaller shelf assembly 14 located between two larger shelf assemblies 14. The smaller shelf assembly 14 can be used for soap or smaller items, and can be placed anywhere along the support member 12.

Additionally, although the illustrated embodiment of the shower caddy 10 has two accessory units 16, the skilled artisan will understand that the shower caddy 10 may have only one accessory unit 16 or as many accessory units 16 as will fit on the shower caddy 10. Furthermore, although the shower caddy 10 in the illustrated embodiment has accessory units 16 having certain configurations, the skilled artisan will appreciate that the accessory units 16 can have different configurations.

Figure 2:
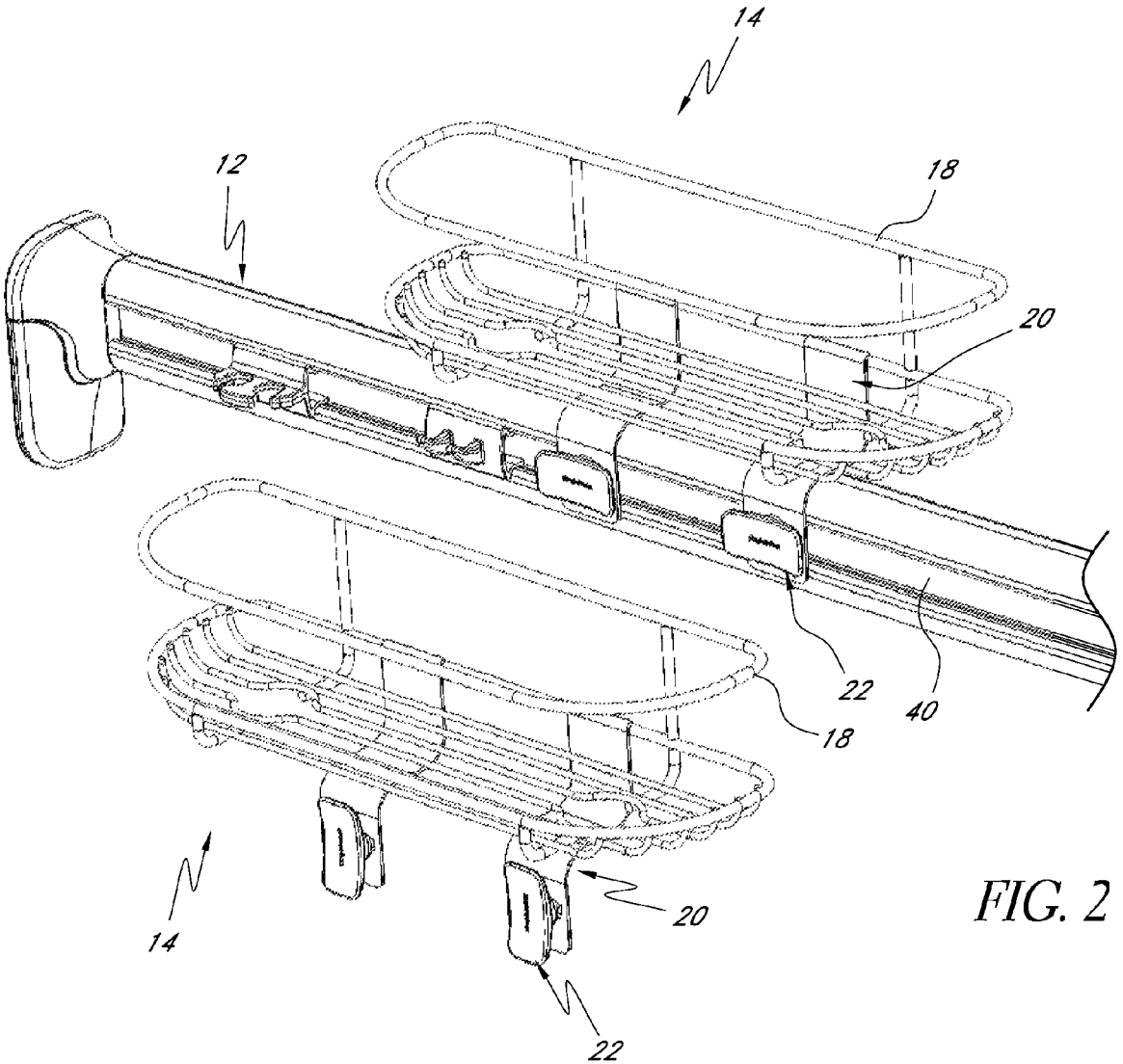
FIG. 2 is a top, front, and left side perspective view of a section of the shower caddy of FIG. 1.
Figure 3:
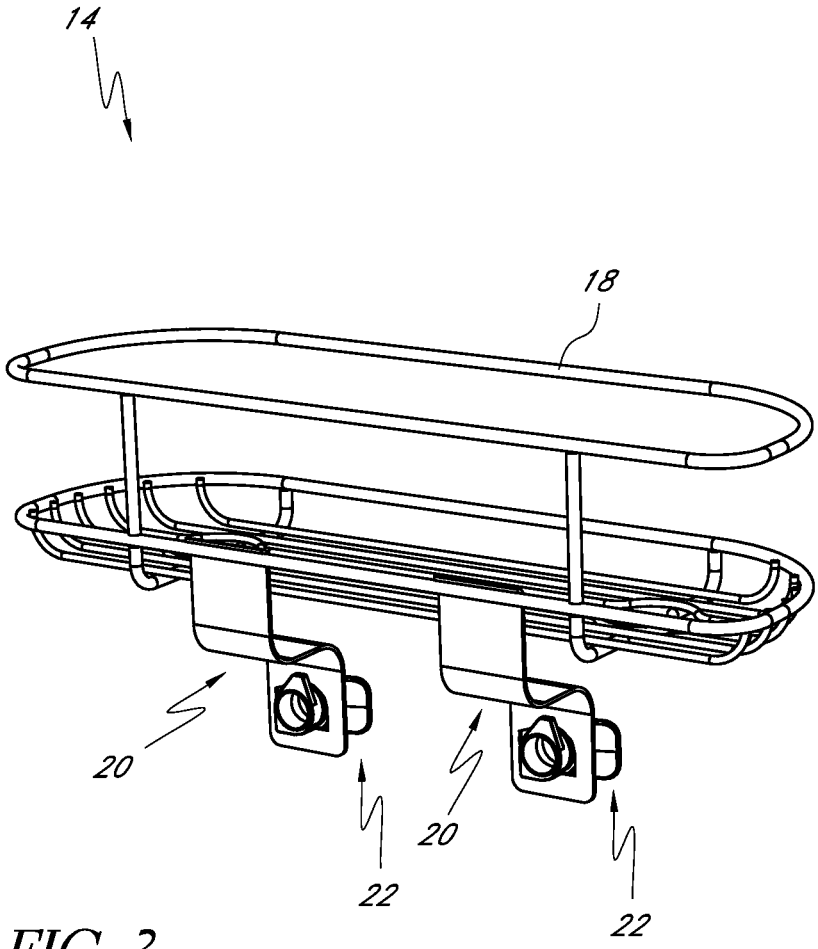
FIG. 3 is a top, rear, and right side perspective view of a removable shelf assembly of the shower caddy of FIG. 1.

With reference to FIGS. 2 and 3, the shelf assembly 14 can include a basket portion 18, at least one bracket 20 connected to or integrally formed with the basket portion 18, and at least one attachment device 22. In some embodiments, such as illustrated in FIGS. 2 and 3, the attachment device 22 can generally comprise a knob which can be turned in at least one direction. With reference to FIG. 2, and as described in further detail herein, the shelf assemblies 14 can be attached to and removed from the support member 12. For example, the attachment devices 22 can be turned to either a locked or unlocked position in order to secure or release the shelf assemblies 14.

With continued reference to FIGS. 2 and 3, the basket portion 18 can comprise, for example, a plurality of stainless steel bars or other structural elements configured to support household items. Together the bars can form a basket configured to hold shower items, including but not limited to shampoo bottles, conditioner bottles, and soap. The bars can be separated by open spaces, or gaps, to allow drainage of excess liquid or other material, in order to prevent material buildup in the baskets.

In some embodiments the basket portion 18 can receive or include a solid tray portion or portions. The tray portion can be used, for example, to hold soap, and can include a plurality of holes to allow for drainage and prevent soap scum buildup on the tray. The tray portion can be removed for cleaning. In some embodiments the tray portion can be small enough to fit in a dishwasher, and be made of a material, such as stainless steel, that is dishwasher safe such that the tray can quickly be removed, washed in a dishwasher, and then placed back on the basket portion 18. In some embodiments, the basket portion 18 can alternatively, or additionally, be made of material that is dishwasher safe, and be small enough to be washed in a dishwasher.

With reference to FIG. 3, the attachment devices 22 of the shelf assembly 14 can extend through a portion of the curved brackets 20, such that a portion of each attachment device 22 remains on one side of the bracket 20, and another portion remains on an opposite side of the bracket 20.

Figure 4A:
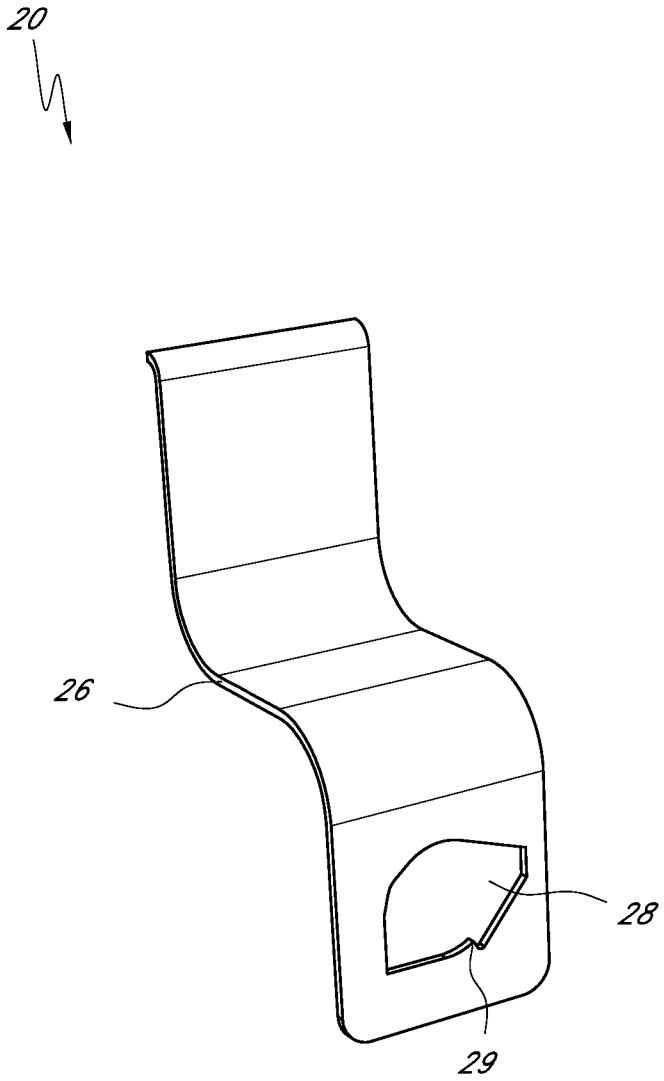
FIG. 4A is a top, front, and right side perspective view of a bracket of the removable shelf assembly of FIG. 3.
Figure 4B:
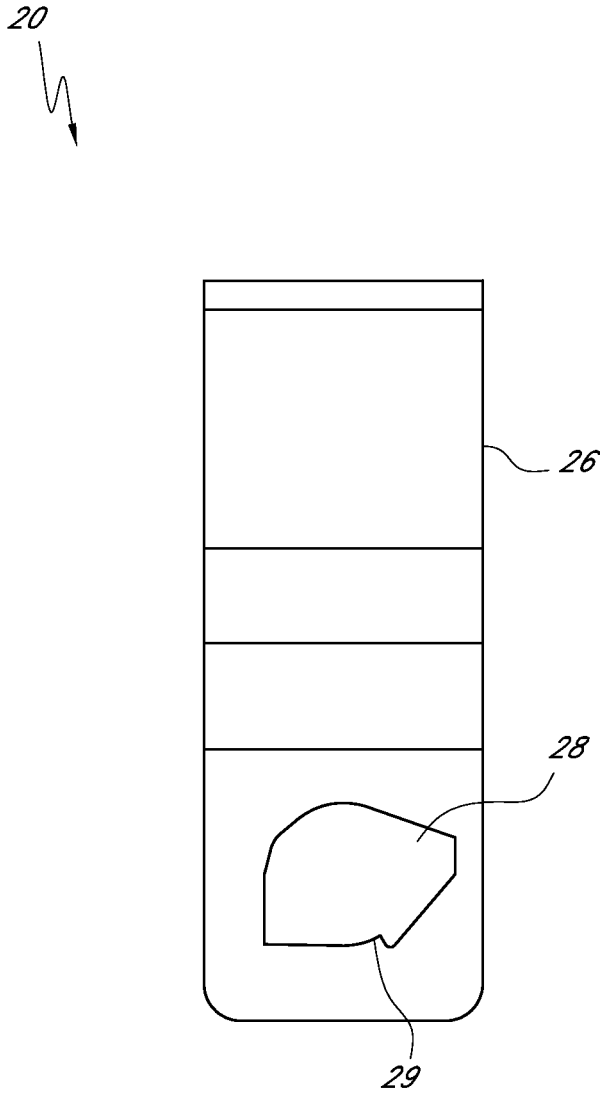
FIG. 4B is a front elevational view of the bracket of FIG. 4A.

With reference to FIGS. 4A and 4B, the brackets 20 can be comprised of stainless steel or other sturdy material capable of withstanding the weight of a basket portion 18 and/or items placed inside the basket portion 18. For example, the basket portions 18 can be used to hold large sized shampoo bottles, which may weigh 32 ounces or more. Such weight can place a significant amount of force on a single bracket 20. In some embodiments, the brackets 20 can be shaped to curve naturally against the profile of the support member 12, as well as maintain a spring-like geometry capable of supporting the weight of the basket's contents. For example, and as illustrated in FIGS. 1 and 4A, the bracket 20 can include a solid curved profile portion 26, at least a portion of which can rest against the support member 12 to facilitate support of the bracket 20 and basket 18.

Figure 5:
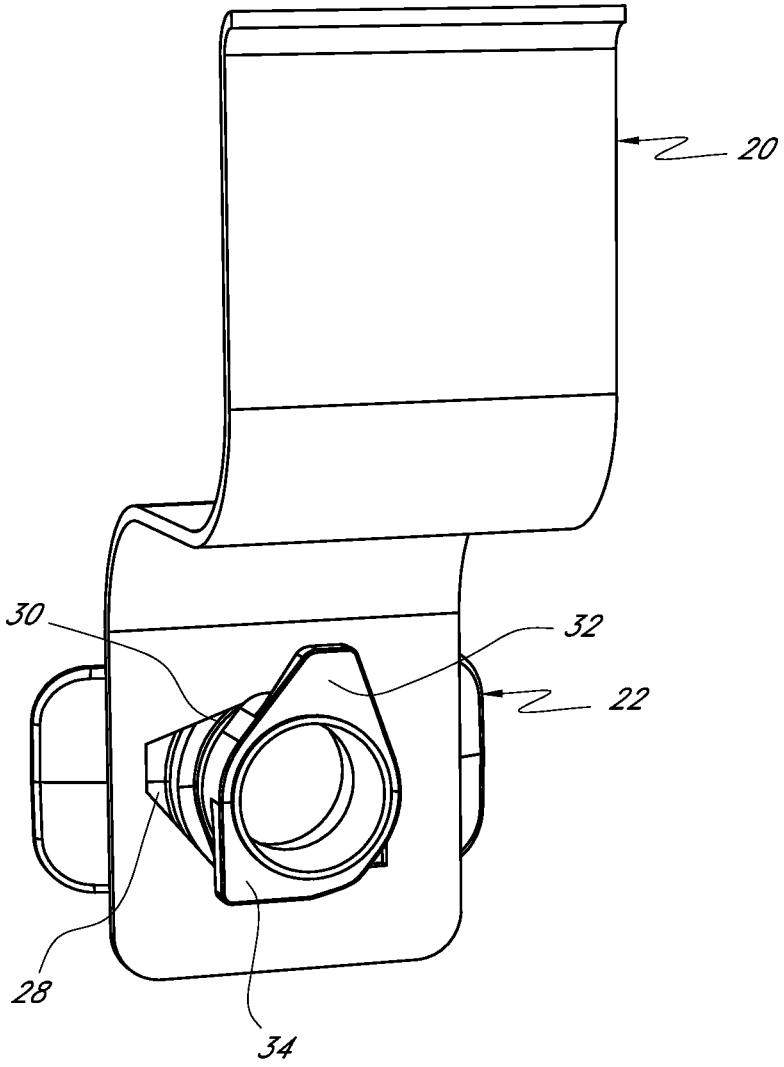
FIG. 5 is a rear and left side perspective view of the bracket of FIG. 4B, with an attachment device extending through the bracket.

With reference to FIGS. 4A, 4B, and 5, the bracket portion 20 can include a cut-out 28. In some embodiments the cut-out 28 can have a shape similar to that of a portion of the attachment device 22, and/or can have a shape large enough such that a portion of the attachment device 22 can be inserted through the cut-out 28 of the bracket portion 20. In some embodiments, the cut-out 28 can comprise a ridge or ridges 29, which can facilitate and/or hamper the ability of the attachment device 22 to turn or rotate within the cut-out 28 once a portion of the attachment device 22 has been inserted through the cut-out 28. For example, in some embodiments the attachment device 22 can include a portion or portions which are configured to contact and interfere with the ridge 29 if the attachment device 22 is turned far enough in one direction or another.

With continued reference to FIG. 5, the shelf assembly 14 can further include a retaining member 30. The retaining member 30 can comprise, for example, an o-ring made of elastic or rubber, which can fit around the attachment device 22. As shown in FIG. 5, the retaining member 30 can sit adjacent or flush with the bracket 20. The retaining member 30 can act to retain a portion of the attachment device 22 within the bracket 20 and prevent the attachment device 22 from slipping out through the cut-out 28, while still allowing the attachment device 22 to be turned or rotated within the cut-out 28. While an o-ring shape is shown, other shapes and sizes of retaining members are also possible, as are other types of material.

Figure 8:
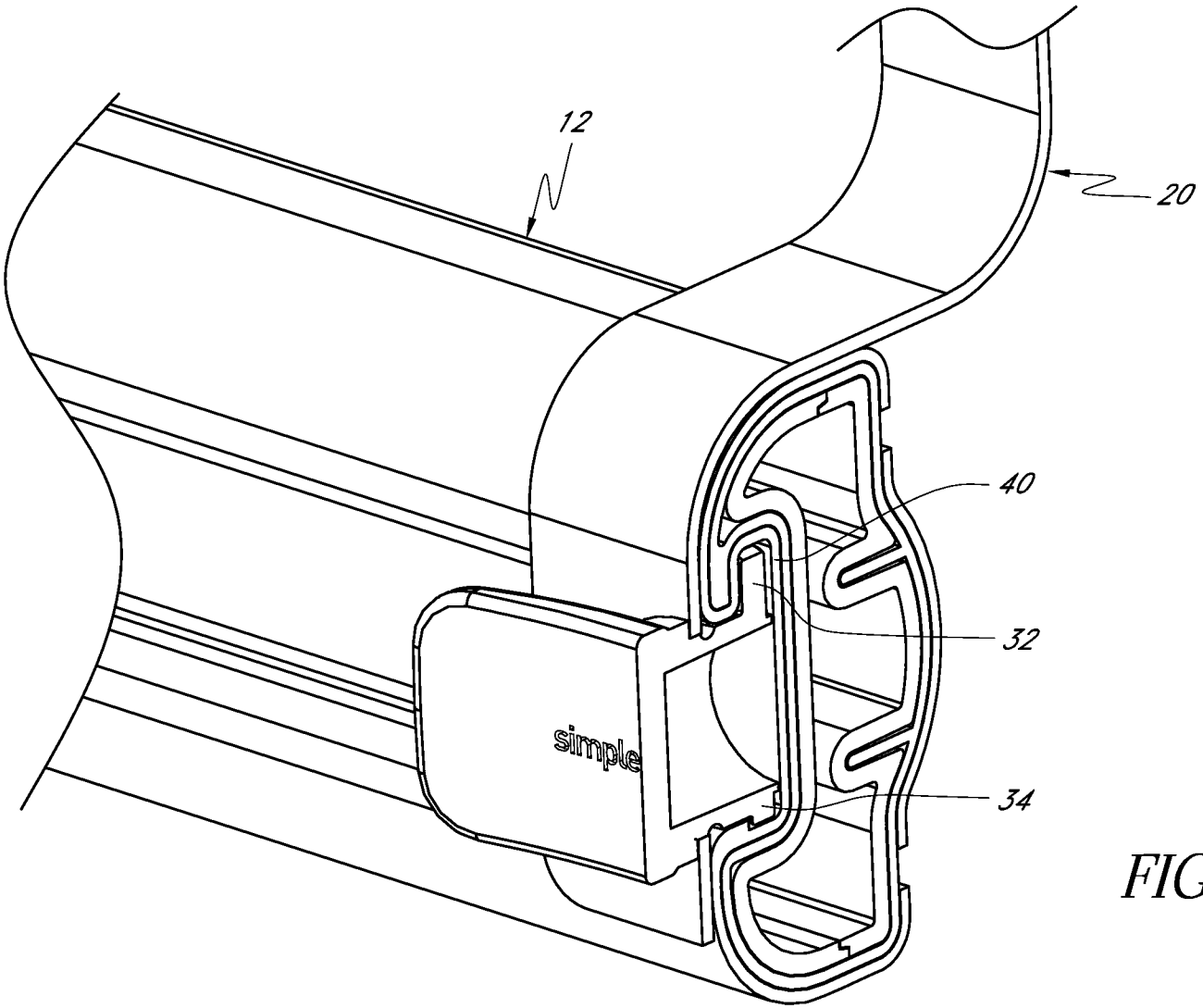
FIG. 8 is a partial top, front, and left side perspective cross-sectional view of the shower caddy of FIG. 1.

With reference to FIGS. 2 and 5-8, the attachment device 22 can include engaging portions 32 and 34, a bump portion 36, and a front portion 38 used to turn the attachment device 22. With particular reference to FIGS. 2, 5, and 8, the engaging portions 32 and 34 can be, for example, flanges on the ends of the attachment device 22 which are configured to engage the support member 12 within a grooved area 40 on the support member 12. The engaging portions 32 and 34 can help to hold the shelf assembly 14 in place when the attachment device 22 is turned into a locked position as shown in FIGS. 5 and 8.

Figure 9:
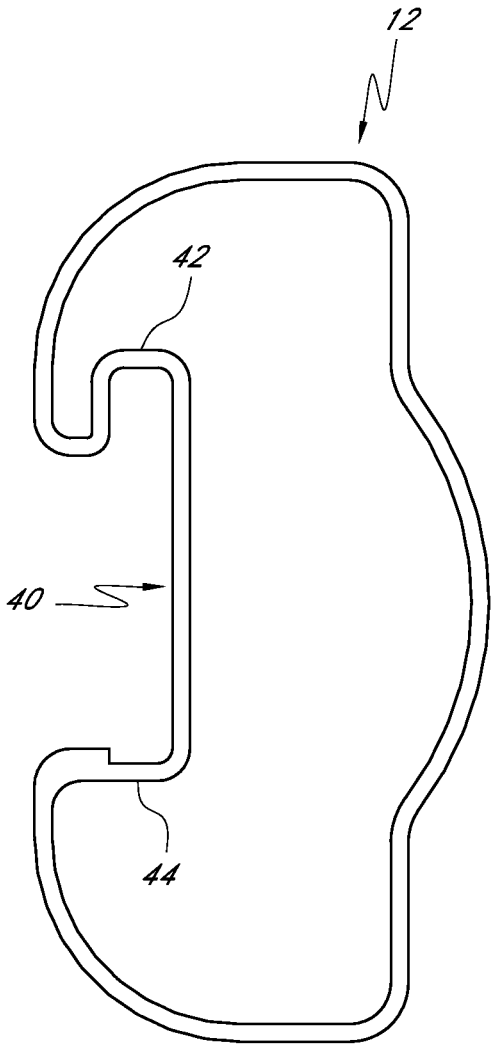
FIG. 9 is a left elevational cross-sectional view of a profile of the support member of the shower caddy of FIG. 1.

With reference to FIGS. 8 and 9, when the attachment device 22 is in the locked position, the engaging portion 32 can contact the upper portion 42 of the grooved area 40, and the engaging portion 34 can contact the lower portion 44 of the grooved area 40, thereby frictionally engaging and securing the shelf assembly 14 in place on the support member 12. Once secured, in at least some embodiments the shelf assembly 14 can be restrained from sliding along the grooved area 40 until the attachment device or devices 22 are unlocked.

With continued reference to FIGS. 8 and 9, if the attachment device 22 is turned, for example, 90 degrees in a counterclockwise direction as viewed from the front portion 38 of the knob, the engaging portions 32 and 34 can turn away from the upper and lower portions 42 and 44, thereby freeing the attachment device 22 from the grooved area 40 and allowing the entire shelf assembly 14 to be removed from the support member 12. In some embodiments, the degree of turning required, as well as the direction of turning, to free or tighten an attachment device 22 can vary, and can be more or less than the 90 degrees described above. Additionally, the amount of force required to turn an attachment device from a locked to an unlocked or unlocked to locked position can vary. For example, in some embodiments, the force of a single user's hand can be sufficient to turn an attachment device. In some embodiments, the amount of force required to tighten the attachment device can be greater than the amount of force to loosen the attachment device.

Figure 6:
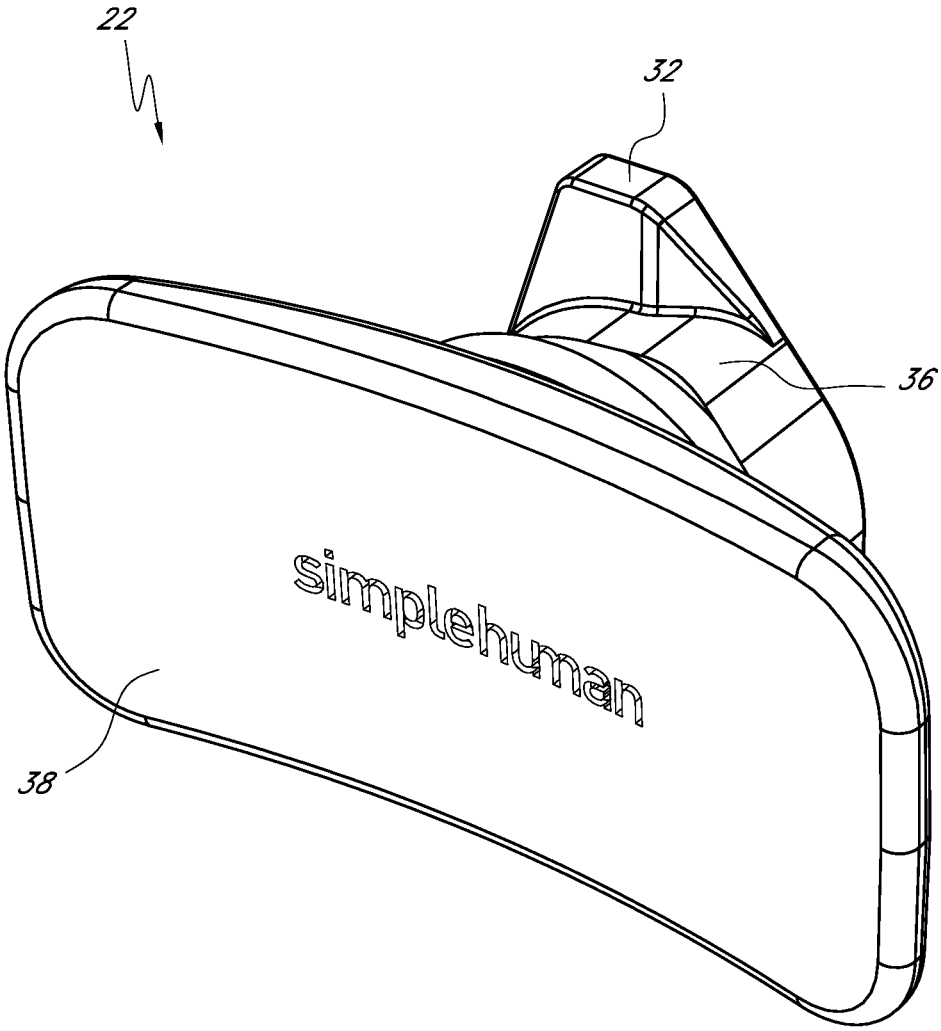
FIG. 6 is a top, front, and left side perspective view of an attachment device of the shower caddy of FIG. 1.
Figure 7:
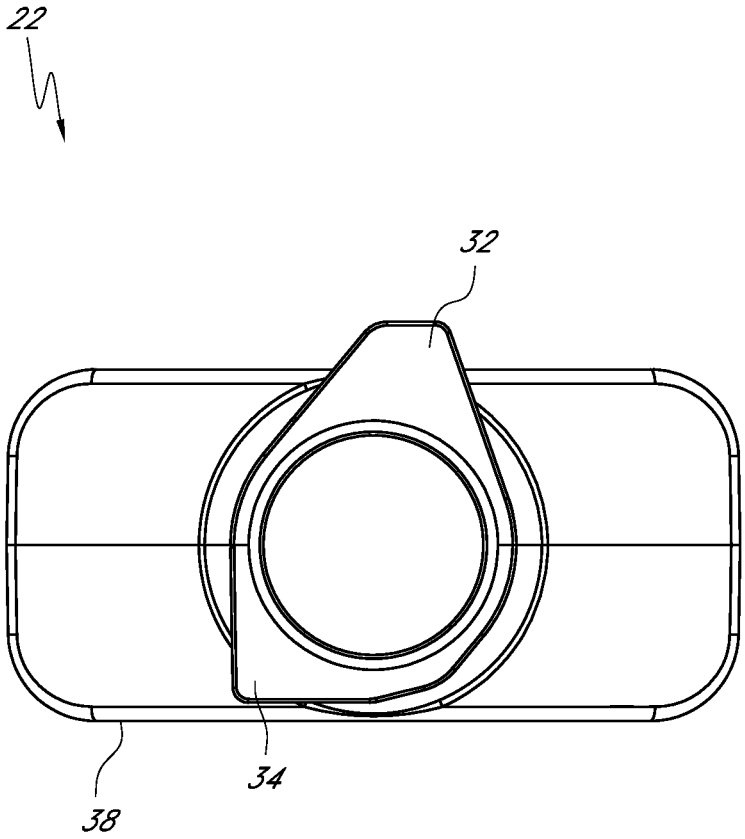
FIG. 7 is a rear elevational view of the attachment device of FIG. 6.

With reference to FIGS. 5, 6, and 8, the bump portion 36 of the attachment device 22 can be a protrusion, bump, or other structure on the attachment device 22. As the attachment device 22 is turned towards the locked position, such as shown in FIGS. 5 and 8, or an unlocked position, the bump portion 36 can provide an interruption or resistance to the turning within groove 40. In order to fully turn the attachment device 22 to either the locked or unlocked position in groove 40, a greater pressure or torque can be applied to the attachment device 22 to force the bump portion 36 to continue moving. In some embodiments the bump portion 36 can thus provide tactile feedback to a user, letting the user know that the attachment device 22 has reached a threshold of one of the locked or unlocked positions.

With continued reference to FIGS. 5, 6, and 8, the bump portion 36 can help inhibit the attachment device 22 from turning on its own. For example, once the attachment device 22 reaches a locked position, the bump portion 36 can inhibit the attachment device 22 from slipping back to an unlocked position (e.g. prevent the attachment device 22 from turning counterclockwise 90 degrees as viewed from the front of the knob 38). Furthermore, while a single bump portion 36 is illustrated in FIG. 6 adjacent the engaging portion 32, in other embodiments different numbers, locations, and/or configurations of bump portions 32 can be used.

Figure 10:
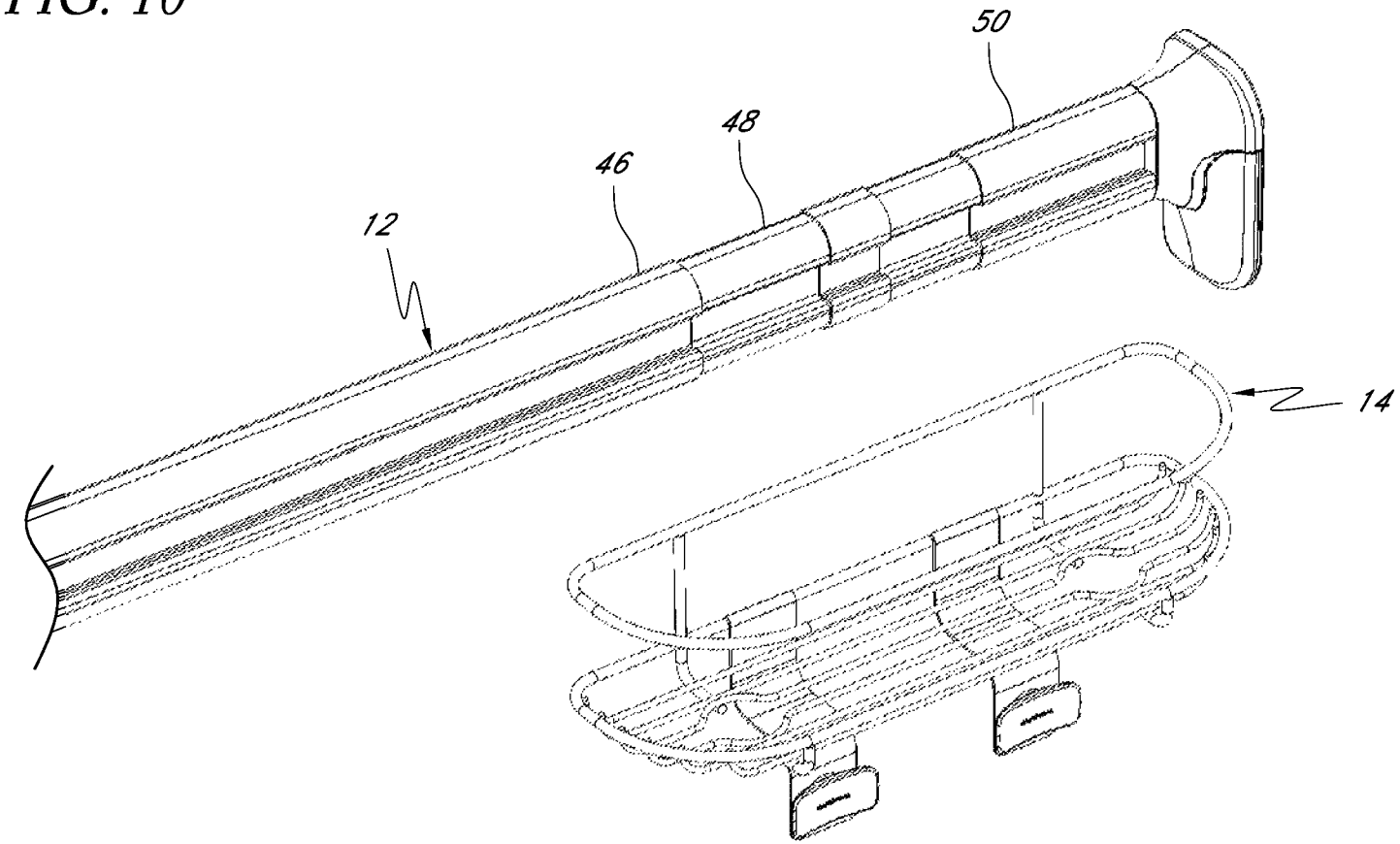
FIG. 10 is a top, front, and right side perspective view of a portion of the shower caddy of FIG. 1.
Figure 11:
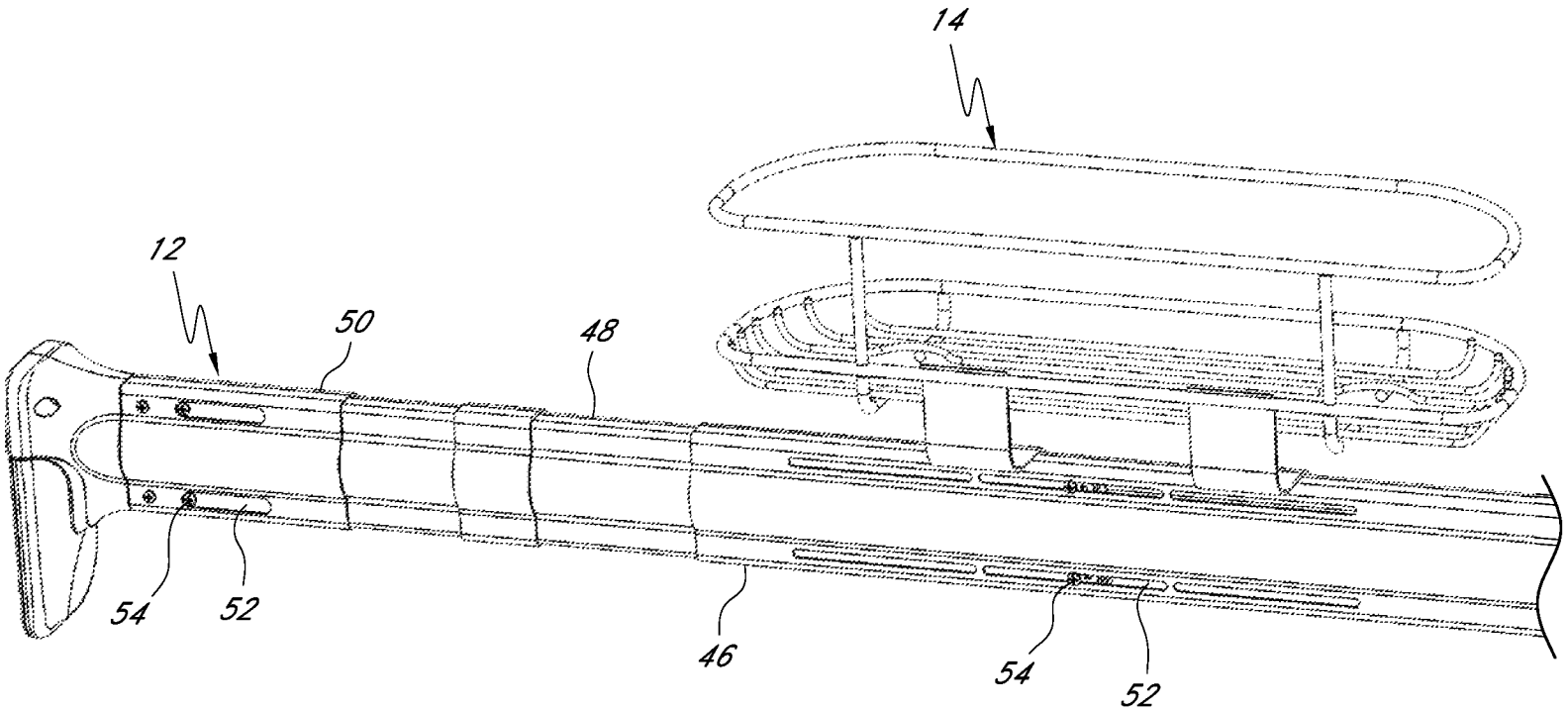
FIG. 11 is a top, rear, and right side perspective view of a portion of the shower caddy of FIG. 1.

With reference to FIG. 10, and as described above, the support member 12 can be adjusted to fit within different types of showers, bathtubs, bathrooms, or other areas where a caddy 10 can be used. In some embodiments, the support member 12 can have a telescoping configuration such that ends of the support member 12 can be pressed against stationary objects, for example the smooth walls of a shower. In some embodiments, the ends of the support member 12 can be adhered to stationary objects such as the smooth walls of a shower, for example with glue.

The support member 12 can include telescoping or nesting segments having outer dimensions that are sized so as to allow at least one of the segments to slide within another segment or segments. For example, and with reference to FIG. 10, the support member 12 can include a first segment 46, a second segment 48, and a third segment 50. The second segment 46 can have a cross-sectional area smaller than that of the first and third segments 46 and 50. The second segment 48 can slide within at least one of the first and third segments 46, 50 in a telescoping manner.

With reference to FIGS. 10-13, in some embodiments, adjustment of the support member 12 can take place in two steps. In the first step, and with reference to FIG. 11, the first and second segments 46 and 48 can be mechanically adjusted. For example, segment 48 can be moved in a telescoping manner inside of segment 46 until the overall length of the support member 12 is generally slightly longer than that of the distance between the shower walls or support structures. Once segments 46 and 48 are adjusted to a desirable length, they can be fastened to each other through a slot or slots 52 with a fastener or fasteners 54. The fasteners 54 can comprise, for example, screws.

In some embodiments, when the second segment 48 is moved relative to the first segment 46, the third segment 50 generally moves with the second segment 48. The third segment 50 can include a slot or slots 52, and a fastener or fasteners 54. Once the first and second segments are secured to one another as described above, the third segment 50 can slide relative to the second segment 48 along the slot or slots 52, with the force of a biasing element 56 pushing the third segment 50 away from the second segment 48. The third segment 50 can be moved, for example, until the fastener or fasteners 54 are contacted.

Figure 12:
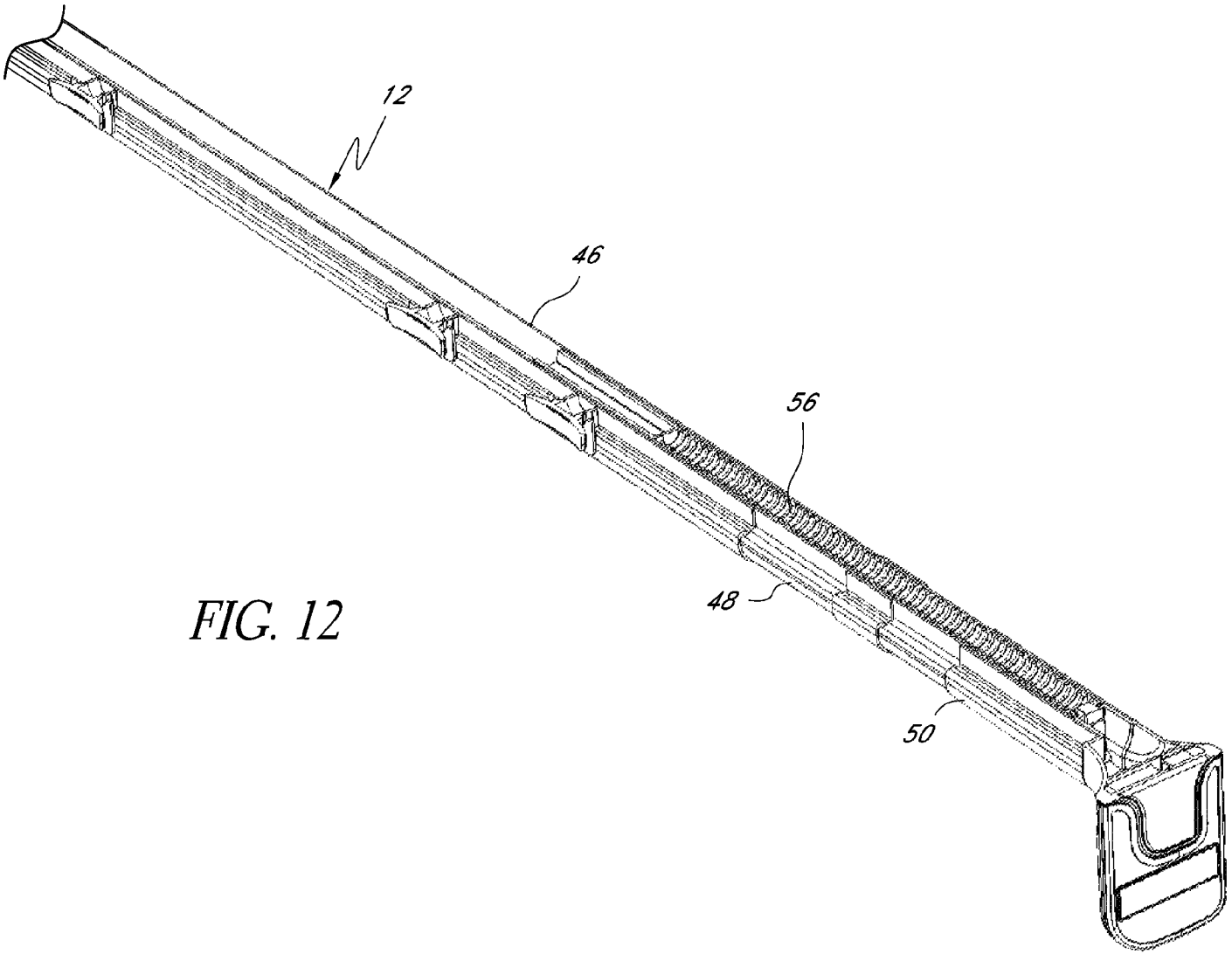
FIG. 12 is a top, front, and left side cross-sectional view of a portion of the shower caddy of FIG. 1.
Figure 13:
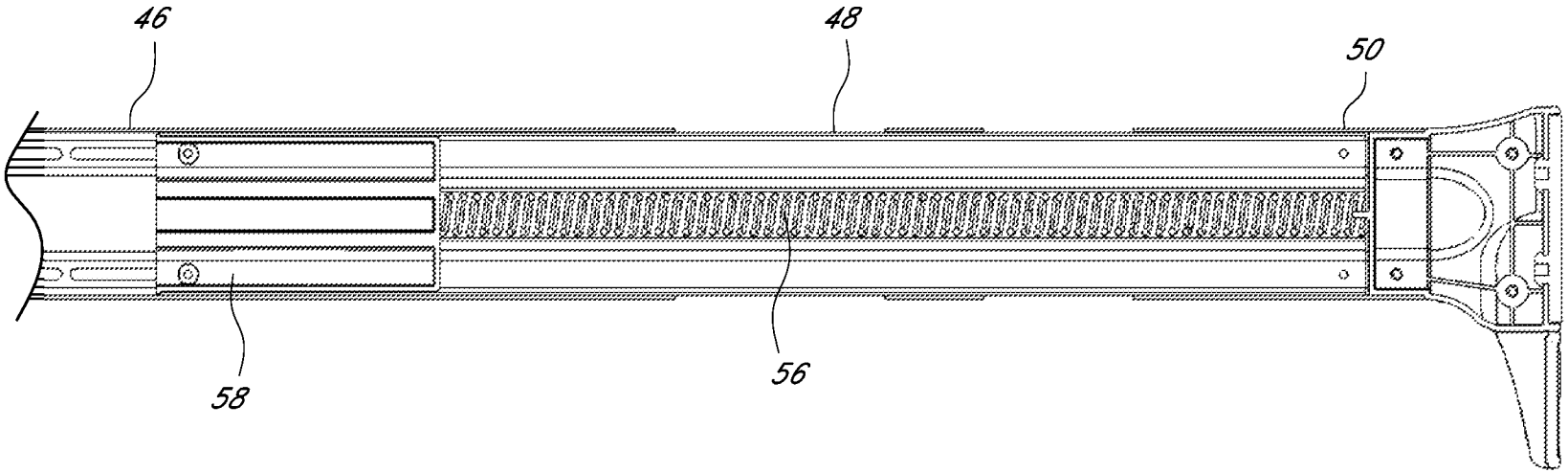
FIG. 13 is a front elevational, cross-sectional view of a portion of the shower caddy of FIG. 1.

With continued reference to FIGS. 12 and 13, in some embodiments the biasing element 56 can comprise an elongate spring, which includes a base portion 58. The base portion 58 can be free floating, along with the rest of the second segment 48, such that the biasing element 56 is not compressed or tensed while the second segment 48 is being moved and adjusted. Once the second segment 48 is at a desired location relative to the first segment 46 as described above, the first segment 46 can be fastened to the base portion 58. This initial step can secure the base portion 58, and second segment 48, in place relative to one another.

Once the base portion 58 is secured in place, the third segment 50 can be pushed in towards the first segment 46 to compress the biasing element 56. The biasing element 56 can be compressed to achieve an overall length small enough to fit the support member 12 between the supporting structures of a shower. Once the support element is placed in between the shower walls, the biasing element 56, which is tensioned, can bias the third segment 50 away from the first and second segments 46, 48. The biasing element 56 can be configured to generate sufficient force to maintain the shower caddy 10 in a horizontal orientation, whether the shower caddy is empty or includes additional items such as common toiletries that may be supported by the shelf assembly 14 and/or removable accessory unit 16. In other embodiments, adhesive can be used to maintain the shower caddy 10 in a horizontal orientation. For example, in embodiments either with or without the biasing element 56, glue can be used on the ends of the shower caddy 10 to maintain the shower caddy in a horiztonal orientation.

Incorporating a free-floating base portion 58 and biasing element 56 can be advantageous. For example, because the biasing element 56 can remain uncompressed and/or free from tension during the initial mechanical adjustment, in some embodiments the ends of the support member 12 can provide substantially the same force or support against the walls of the shower regardless of the length chosen for the support member 12. This is in contrast to a biasing element 56 which is constantly tensioned and/or stretched as the length of the support member 12 is adjusted. If the biasing element 56 is substantially stretched during adjustment, it can lose some of its biasing tension, thereby weakening the amount of force or support the support member 12 can provide inside the shower.

Figure 14:
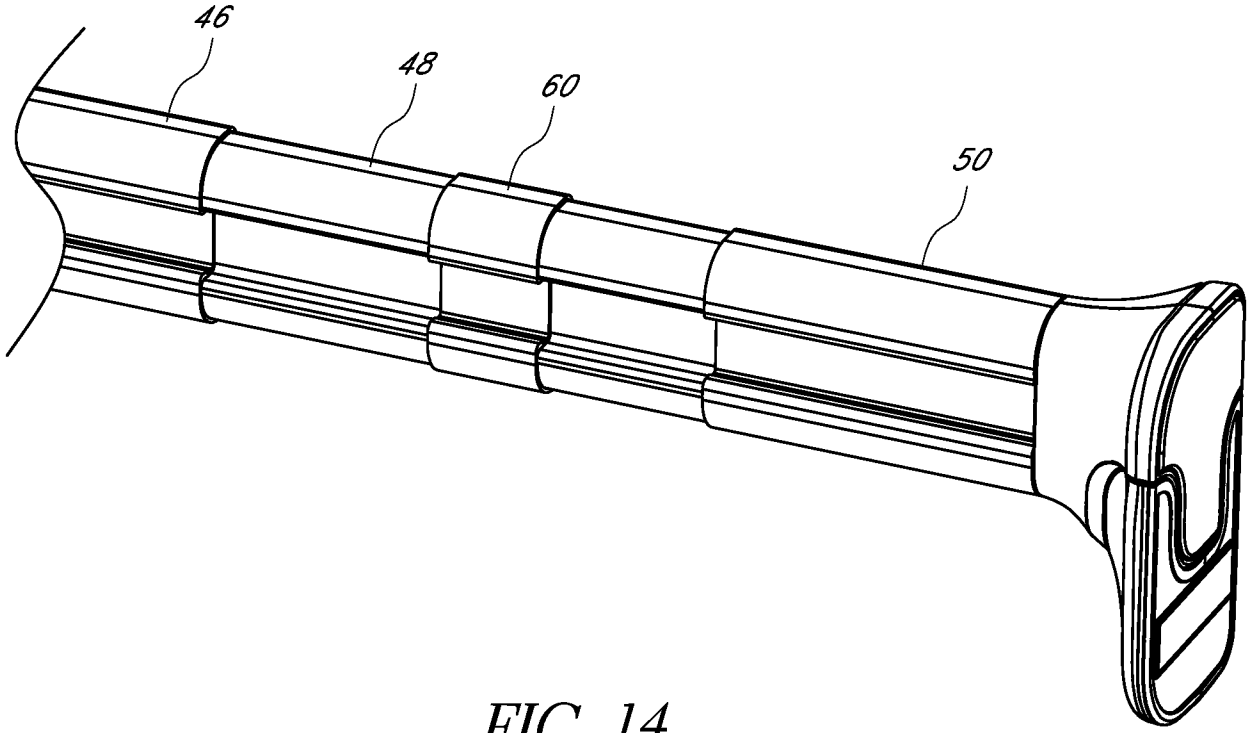
FIG. 14 is a top, front, and left side perspective view of a portion of the shower caddy of FIG. 1, including a sliding member.

With reference to FIGS. 9 and 14, and as described above, the second segment 48 can have a cross-sectional area and profile which is smaller than that of the first and third segments 46, 50. It can be difficult to attach a shelf assembly 14 and/or removable accessory unit 16 to the support member 12 since the grooved portion 40 of the second segment 48 can have a smaller profile from that of the grooved portion 40 of the rest of the support member 12.

Thus, the shower caddy 10 can further include a separate sliding element 60. With reference to FIG. 14, the sliding element 60 can have the same cross-sectional area and shape as that of the first segment 46 and/or third segment 50, and can be attached to or fit over the second segment 48. The sliding element 60 can provide an area for attachment of an attachment device 22 of one of the shelf assemblies 14, or for a removable accessory unit 16. The sliding element 60 can move freely along the length of the second segment 48. In some embodiments, without the sliding element 60, a shelf assembly 14 would not be able to attach to the support member 12 along the second segment 48. Thus, the sliding element 60 can provide the support member 12 with a wider range of attachment areas and options for shelving assemblies 14, removable accessory units 16, and/or any other elements which can be attached to the support member 12.

Figure 15:
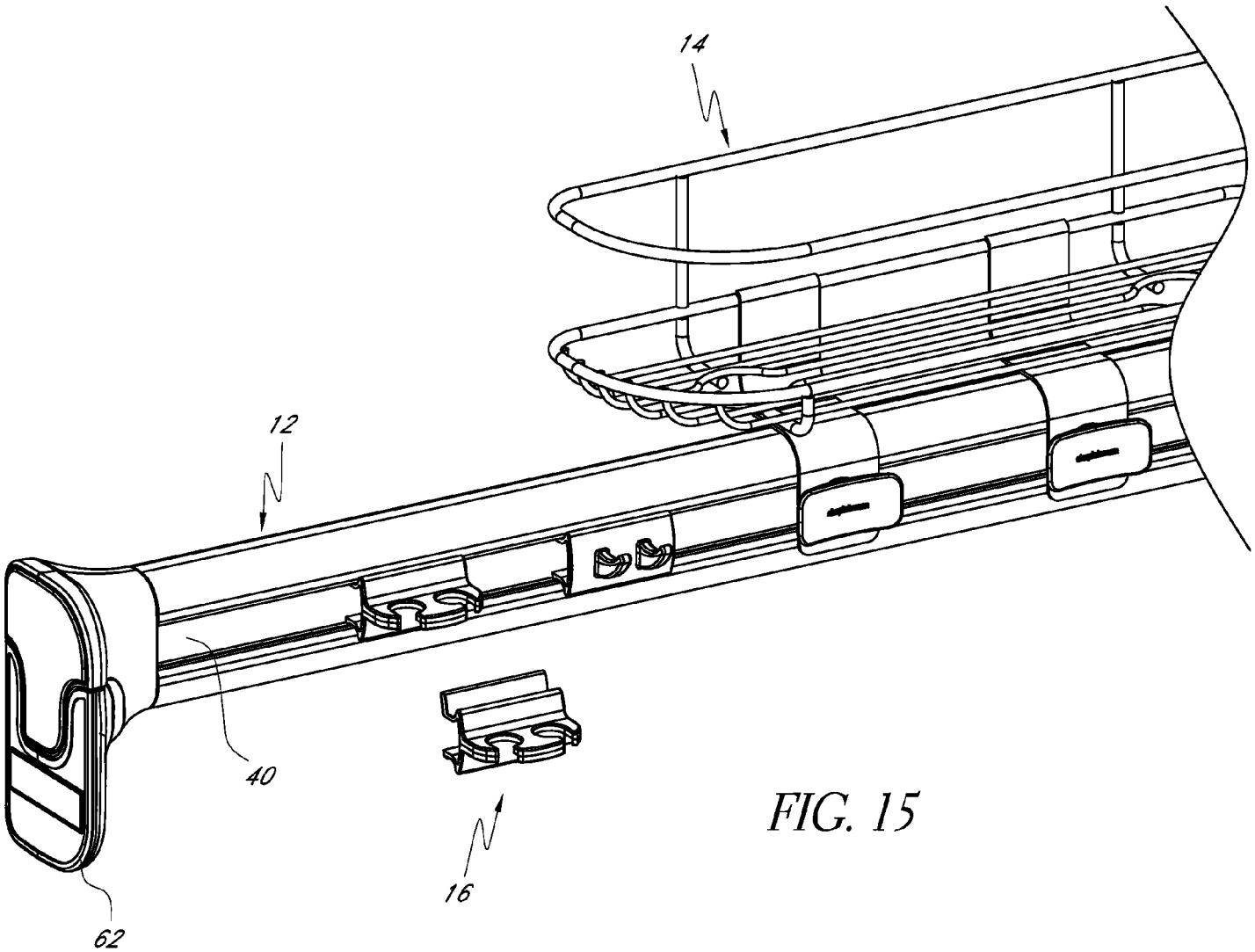
FIG. 15 is a top, front, and right side perspective view of a portion of the shower caddy of FIG. 1.
Figure 16:
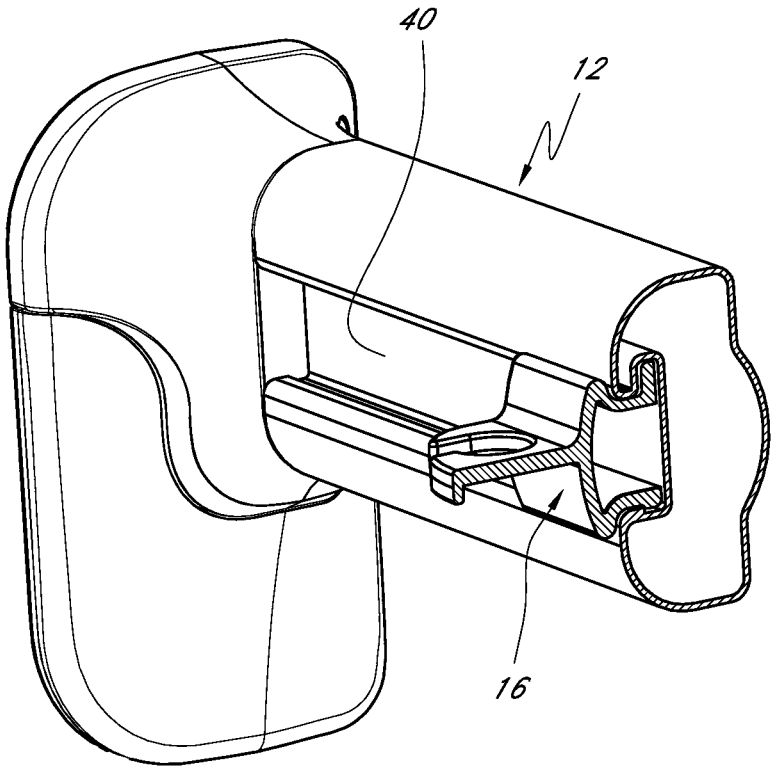
FIG. 16 is a top, front, and left side perspective view cross-sectional view of a portion of the shower caddy of FIG. 1.

With reference to FIGS. 15 and 16, the removable accessory units 16 can come in a variety of shapes and configurations. For example, the removable accessory units 16 can include hooks, openings, and/or other structures which are configured to receive accessory items. In some embodiments, the removable accessory units 16 can receive, for example, towels, toothbrushes, razors, and/or small bottles.

With reference to FIGS. 9, 15 and 16, the removable accessory units 16 can quickly be attached to and removed from the grooved portion 40 of the support member 12. For example, the removable accessory units 16 can include portions which snap fit into the upper 42 and lower 44 portions of the grooved area 40. These portions can be made of material which is flexible enough to snap in and out of the grooved area 40, allowing for easy removal and attachment of the removable accessory units 16. In some embodiments, the removable accessory units 16 can slide along the grooved area 40 of the support member 12. In some embodiments, the removable accessory units 16 can be held firmly in place once they are snapped into the groove 40.

With reference to FIG. 15, the support member 12 can also comprise feet 62. The feet 62 can be configured to provide traction when the ends of the support member 12 are pressed against surfaces such as the walls of a shower. For example, but without limitation, the feet 62 can be made of rubber, silicon, or any other material that can provide enhanced traction in the caddy's environment of use. In some embodiments, the feet 62 can include suction-cup-like structures which can facilitate traction.

The terms of orientation, as used herein, such as "upper," "lower," "horizontal," and "end" are used in the context of the illustrated embodiment. Because other orientations are possible, however, the present inventions should not be limited to the illustrated orientation. The skilled artisan will appreciate that other orientations are also possible.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A shelving system comprising: an elongate support member, the elongate support member comprising a first segment, a second segment including a biasing element, and a third segment, the first segment, the second segment, and the third segment telescopingly engaged with each other;

a groove extending along a length of the elongate support member; at least one removable shelf assembly attached along the elongate support member, the at least one removable shelf assembly comprising a bracket, an opening extending through the bracket, and an adjustable knob extending through the opening, the adjustable knob comprising a first engaging portion and a second engaging portion, the first and second engaging portions being frictionally engaged with separate portions of the groove, respectively, when the knob is in a locked position, and disengaged with the separate portions of the groove when the knob is in an unlocked position, wherein the shelving system is configured to be secured in a horizontal orientation between two generally opposite surfaces inside a shower.

2. The shelving system of claim 1, wherein the at least one shelf assembly is configured to be attached to the elongate support member at any point along the groove.

3. The shelving system of claim 1, wherein the knob comprises a raised bump portion configured to provide resistance to twisting of the knob and provide an indication that the knob is approaching the locked or unlocked position.

4. The shelving system of claim 1, wherein the opening extending through the bracket forms a ridge along the bracket configured to hamper the ability of the knob to twist within the opening.

5. The shelving system of claim 1, wherein the bracket is attached to a basket portion of the at least one removable shelf, the basket portion comprising a removable stainless steel tray.

6. The shelving system of claim 1, further comprising a retaining member, the retaining member fitted around a portion of the knob.

7. The shelving system of claim 6, wherein the retaining member is an o-ring.

8. The shelving system of claim 1, wherein the second segment is adjustable relative the first segment, and is configured to be locked in place relative the first segment once adjusted, and wherein the biasing element is configured to provide sufficient biasing force to support ends of the elongate support member and maintain the shelving system in the horizontal orientation.

9. The shelving system of claim 8, wherein the ends of the elongate support member are pressed against smooth walls.

10. The shelving system of claim 9, wherein the smooth walls are shower walls.

11. The shelving system of claim 8, wherein the ends of the shelving system include adhesive to maintain the shelving system in the horizontal orientation.

12. The shelving system of claim 1, wherein the separate portions of the groove comprise an upper portion and a lower portion of the groove.

* * * * *